United States Patent [19]

Hizume

[11] 4,429,551

[45] Feb. 7, 1984

[54] AUGER TYPE ICEMAKER

[75] Inventor: Akio Hizume, Nagoya, Japan

[73] Assignee: Hoshizaki Electric Co., Ltd., Toyoake, Japan

[21] Appl. No.: 373,139

[22] Filed: Apr. 29, 1982

[51] Int. Cl.[3] ..... F25C 1/14; F25C 5/14

[52] U.S. Cl. ..... 62/354; 100/149; 425/208; 425/380

[58] Field of Search ..... 62/354; 100/145, 147–150; 425/208, 380, 464, 467; 264/117, 118, 141–143

[56] References Cited

U.S. PATENT DOCUMENTS

| | | | |
|---|---|---|---|
| 3,196,628 | 7/1965 | Reynolds | 62/354 X |
| 3,276,223 | 10/1966 | Lunde | 62/354 X |
| 3,354,666 | 11/1967 | Beusch et al. | 62/354 |
| 3,744,266 | 7/1973 | Beusch | 62/354 X |
| 3,910,060 | 10/1975 | Beusch | 62/354 X |
| 4,250,718 | 2/1981 | Brantley | 62/354 |

FOREIGN PATENT DOCUMENTS 54-26300 9/1979 Japan .

*Primary Examiner*—William E. Tapolcai

*Attorney, Agent, or Firm*—Wenderoth, Lind & Ponack

[57] ABSTRACT

In an auger type icemaker comprising an auger in a refrigeration cylinder, an extrusion head disposed in the upper end of the auger, and a plurality of bosses disposed in the extrusion head ice compressing passages and extending axially downward and radially outward, to prevent choking of ice particles in the refrigeration cylinder, the bosses extending further downward at a predetermined distance from the lower end surface of the extrusion head and partially overlap the auger. The diameter of the auger corresponding to the overlapping portion is smaller than that of the other portions.

4 Claims, 6 Drawing Figures

FIG. 4
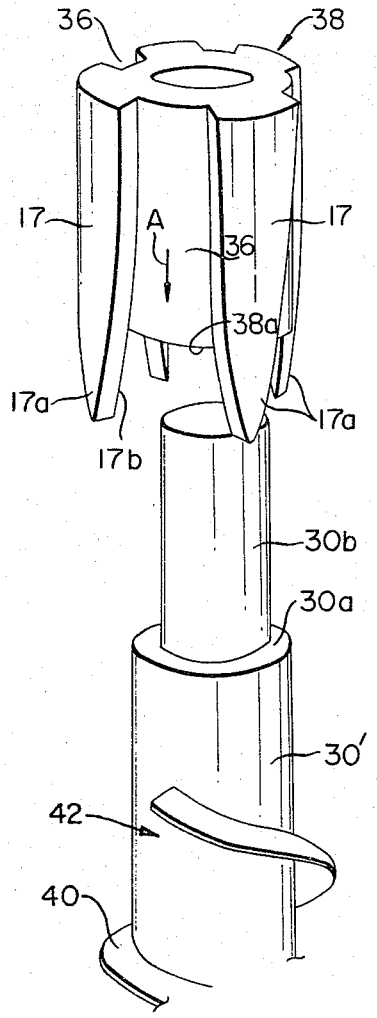
FIG. 5
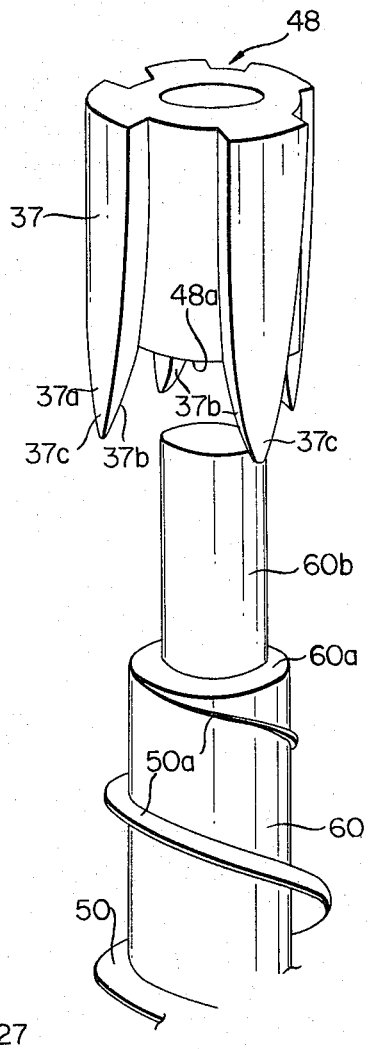
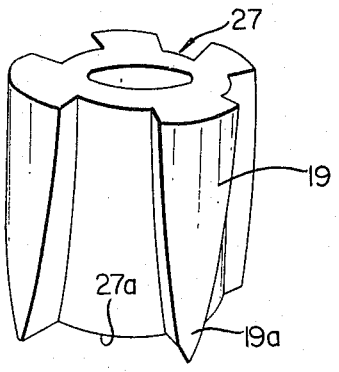
FIG. 6 PRIOR ART

AUGER TYPE ICEMAKER

BACKGROUND OF THE INVENTION

The present invention relates to an auger type icemaker and, more particularly, to an improvement of the extrusion head thereof.

An auger type icemaker is well known in which a water inlet is connected to a refrigeration cylinder having an evaporator of the refrigeration system disposed therearound, a rotatable auger is disposed in the interior of the cylinder and an extrusion head is attached to the upper end thereof. In this icemaker, slush ice formed on the inner wall surface of the refrigeration cylinder is scraped off by said rotatable auger and is guided upward in succession. In the extrusion head, a plurality of bosses are formed to extend axially downward and radially outward, and ice compressing passages are formed between adjacent bosses. Accordingly, said slush ice is compressed together through ice compressing passages and is directed out through discharge ports. However, in such an icemaker, the radial cross sections of the compressing passages disposed in the extrusion head are formed to become small as they approach the discharge ports so as to obtain, by increasing the ice compression ratio, a good quality of less watery ice chunks ordinarily called chip ice.

Therefore, a great pushing force is needed when slush ice is carried into the ice compressing passages and passes through them. However, when the quantity of the carried ice is slightly more than that of the compressed ice, such as in winter, an additional pushing force is needed for passing the ice through the compressing passages of the extrusion head, and ice particles are apt to rotate with the rotatable auger in the circumferential direction, leading to stoppage of the rising ice particles, i.e., choking of the ice.

To remove the above disadvantages, the auger type icemaker shown in FIGS. 1 to 3 has been heretofore presented. In this icemaker, a single rib or a plurality of ribs 22 extending downward at a predetermined length and spacing are embedded in the inner wall surface of the refrigeration cylinder 10 just below the extrusion head 18 attached inside the upper end of the cylinder 10 by means of, for example, set screws. The diameter of the part of spiral edge of the rotatable auger 20 corresponding to said ribs is formed to be slightly smaller than the diameter remaining lower portion of the spiral edge of the auger, so as to rotate free contact with ribs 22. Thus, the rotation of ice particles with the rotatable auger 20 is prevented by ribs 22, and the ice particles are forced to move upward thereby to obtain a much greater pushing force than the one needed when they pass through ice compression passages 16 of the extrusion head 18, leading to prevention of the condition where ice cannot pass through passages 16 of the extrusion head 18, i.e., the occurrence of choking. The above conventional auger type icemaker has a very excellent advantage in that the occurrence of ice choking is effectively prevented. However, since the ribs 22 embedded in the inner surface of the refrigeration cylinder 10 are constituent elements for obtaining the above advantages, there exist the following problems in the manufacture of the cylinder.

(1) Notches 23 must be formed so as to embed ribs in the refrigerated cylinder, and a troublesome cutting operation is needed to form the notches since they are not through grooves.

(2) The ribs must have a magnitude large enough to prevent rotation of ice particles, so that a difficult welding-in operation is needed in the interior of the refrigeration cylinder after the ribs are embedded therein. Furthermore, there is the possibility of ribs falling out due to poor welding or fatigue of the welding portions.

(3) There are cases where distortion occurs in the refrigeration cylinder due to the rib welding.

The object of the present invention is to provide an improved auger type icemaker which removes the above problems of the conventional auger type icemaker without inducing choking of the ice particles.

SUMMARY OF THE INVENTION

An auger type icemaker according to the present invention in general comprises a refrigeration cylinder having an evaporator disposed therearound and a water inlet connected thereto in fluid association with the interior of the cylinder to form slush ice on the inner surface of said cylinder, an auger including a rotary shaft rotatably disposed in the cylinder and a coiled scraper blade fixedly mounted around the shaft to scrape off and guide the slush ice upwardly, an extrusion head fixedly mounted at the upper end of the cylinder with a plurality of axially downwardly and radially outwardly extending bosses disposed around the periphery of the extrusion head to form ice compressing passages between the adjacent bosses, the passages receiving the scraped slush ice from the auger and discharging it therefrom after it is compressed during its passing through the passages, each of said bosses having an extension of a predetermined axial length positioned below the lower end surface of the extrusion head and over a portion of the auger, and structure for preventing interference of the extension with the portion of said auger said interference preventing structure being provided by selecting the diameter of the auger so that the portion of the auger over which said extensions are positioned is smaller in diameter than the other portions of the auger.

BRIEF DESCRIPTION OF THE DRAWINGS

FIG. 4 is an exploded perspective view of the extrusion head and auger of the auger type icemaker according to the present invention;

FIG. 5 is a view similar to FIG. 4 showing another embodiment of the present invention;

FIG. 6 is a perspective view showing another embodiment of the extrusion head of the conventional auger type icemaker.

DESCRIPTION OF THE PREFERRED EMBODIMENT

Figure 1:
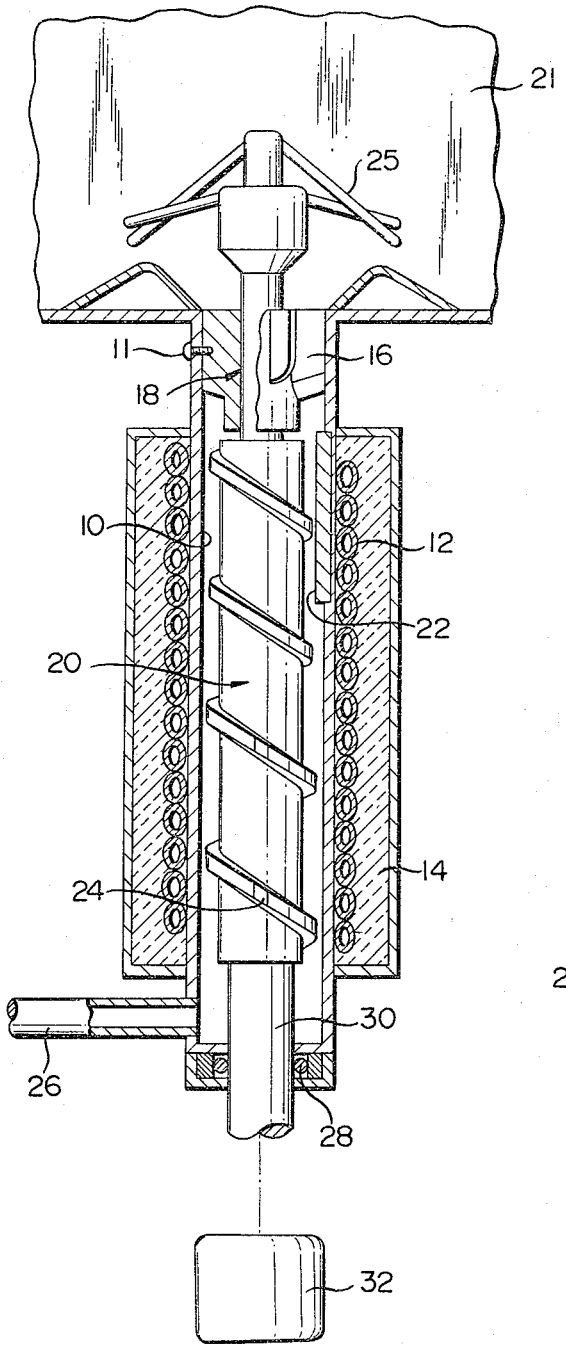
FIG. 1 PRIOR ART
FIG. 1 is a longitudinal sectional view of a conventional auger type icemaker.

FIG. 1 shows a longitudinal sectional view of the conventional auger type icemaker. An icemaker according to the present invention is similar to that of FIG. 1 in the general structure of the auger type icemaker. That is, as shown in FIG. 1, an evaporator 12 of a refrigerating system is disposed on the circumferential portion of a refrigeration cylinder 10 and the circumference of the cylinder is surrounded by an insulating material 14. An extrusion head 18 is disposed in the upper end of the refrigeration cylinder 10 and has ice compressing passages 16 whose cross sections gradually descrease as they go upward. An auger 20 comprising a spiral blade 20' and a shaft 30 extends through the refrigeration cylinder 10. The lower portion of the shaft 30 is rotatably supported by a bearing 28 and the upper portion thereof extends further upward and enters into an ice hopper 21. At the top of shaft 30 is an agitator 25 for stirring the ice. A water inlet 26 is connected to the bottom portion of cylinder 10 and the shaft 30 is connected to a driving motor 32 through a suitable reduction mechanism.

In the auger type icemaker having the above structure, water supplied from the lower portion of the refrigeration cylinder 10 through the water inlet 26 is cooled by the evaporator 12 and is formed into a thin ice layer on the inner wall surface of cylinder 10. The thin ice layer is scraped off by the spiral edge (blade) 20 and is pushed upward in succession while being rotated and is guided to ice compressing passages 16 formed in the extrusion head 18. The particles are further compressed in these passages into less watery ice chunks of good quality and are stored in the ice hopper 21.

Figure 2:
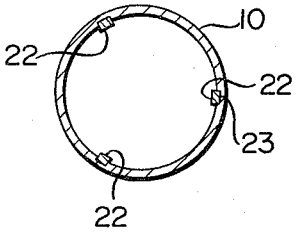
FIG. 2 PRIOR ART
FIG. 2 is a sectional view of the refrigeration cylinder of the auger type icemaker of FIG. 1.
Figure 3:
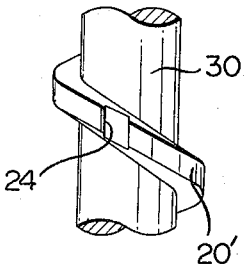
FIG. 3 PRIOR ART
FIG. 3 is an elevational view of the auger.

According to the present invention as shown in FIG. 4, in place of the ribs embedded in the inner surface of the refrigeration cylinder in conventional icemakers (FIGS. 1–3), lower ends 17*a* of the bosses 17 forming ice compressing passages 36 extend further downward by a predetermined length long enough to prevent rotation of ice particles together with the auger 42, preferably a length corresponding to the conventional rib length, and are positioned below the lower end surface 38*a* of extrusion head 38. In assembly, the extrusion head 38 is inserted into the shaft upper end 30*b* in the direction of the arrow A until the lower end surface 38*a* touches or approximates the shoulder portion 30*a* of shaft 30' of auger 42. Then, the extrusion head is fixed into the refrigeration cylinder in the conventional manner. Accordingly, a spiral blade 40 is provided such that a spiral blade is not formed near the shoulder portion 30*a* of shaft 30' so as to prevent the boss lower end 17*a* of refrigeration cylinder 38 from entering into the rotation area of the spiral blade 40 and creating mutual interference.

Furthermore, another extrusion head and spiral edge as shown in FIG. 5 may be formed as a modification of FIG. 4. That is, although the radially inner surface 17*b* of lower end 17*a* in each boss 17 of the extrusion head 38 extends straight downward parallel to the axis center from the lower end surface 38*a* of the extrusion head in the case of the embodiment of FIG. 4, the radially inner face 37*b* extends slanting radially outward toward the lowest end of the radially outward surface 37*c* of lower end 37*a* in the care of boss 48 of the embodiment of FIG. 5. Accordingly, the space surrounded by the lower ends 37*a* of the four bosses 37 is of such a shape that the radius thereof becomes large as it becomes distant from the lower end surface 48*a*. A part 50*a* near the shoulder portion 60*a* in the spiral blade 50 disposed in the shaft 60 below shaft upper end 60*b* is formed to gradually decrease in radial size, i.e., in height of the edge, so as to fit the part into the above space. Thus, the spiral blade part 50*a* and the boss lower ends 37*a* do not interefere with each other.

Next, the operation of the embodiment constituted as above will be explained. In the case of the embodiment of FIG. 4, when flake shaped ice particles rotating and ascending due to the auger spiral blade 40 reach the lowest end of boss 17, their spiral movement is prevented by the lower end 17*a* and they move straight upward without causing ice choking. Subsequently, the ice particles enter into ice compressing passages 36 of the extrusion head 38 and finally become ice bars and are discharged into the hopper 21 from delivery ports of ice compressing passages 36, i.e., upper openings.

Alternatively, in the case of the embodiment of FIG. 5, boss lower ends 37*a* that ice particles first reach are radially positioned much away from the shaft center, and the blade height of the spiral edge part 50*a* corresponding to lower ends 37*a* generally complete. Therefore, in this position, a sufficient compressing force is not yet applied to the ice particles so that the component force making ice particles run idle is small. However, since the radial size of the lower end 37*a*, i.e., the thickness thereof, increases as the ice particles ascend, lower ends 17*a* can reliably prevent idle running even though the component force of the idle running increases as compressing force increases. Accordingly, idle running is prevented as a whole. On the other hand, the edge height of the spiral edge part 50*a* gradually decreases. Ice particles are still completely in the shape of flakes in the lowest end of the boss and are solidified as they ascend and become solid almost completely about the middle of the ice compressing passages so that their propulsive force are maintained in the intermediate process even though the edge height becomes low as the ice particles ascend.

In particular, in both embodiments of the present invention, the axial length of the ice compressing passages, at least from the lower end surface of the extrusion head to the lowest end of the boss, is long compared with the extrusion head of FIG. 1 or compared with the extrusion head shown in FIG. 6 in which the lowest ends 19*a* of the boss 19 are on the same plane as the lower end surface 27*a* of the extrusion head 27). Therefore, the sides of bosses 17 and 37 defining the ice compressing passages can draw natural curves and extend downward in the shape of an unfolded fan so that ice particles can be more smoothly compressed.

According to the structure mentioned above for the present invention, the following various effects are obtained.

(1) The ice compressing passages virtually become longer and compression can be performed more smoothly.

(2) There is no need to cut grooves in the refrigeration cylinder and the auger.

(3) The number of parts is reduced by the number of ribs.

(4) There is no need for weld-processing of the ribs and finishing thereof after the welding.

(5) There is no distortion of the refrigeration cylinder by welding.

(6) Falling out of the ribs is eliminated.

It will be understood that although the extrusion head has four bosses in the embodiments, the present invention is not confined to the above number, and the length of the extensive portions of the boss ends and the boss shape are not confined to the embodiments shown in the Figures, but may be suitably determined.

What I claim is:

1. An auger type icemaker comprising a refrigeration cylinder having an evaporator disposed therearound and a water inlet connected thereto in fluid communication with the interior of said cylinder to form slush ice on the inner surface of said cylinder, an auger including a rotary shaft rotatably disposed in said cylinder and a coiled scraper blade fixedly mounted around said shaft to scrape off and guide the slush ice upwardly, and an extrusion head having a lower end surface, fixedly mounted at the upper end of said cylinder with a plurality of axially downwardly and radially outwardly extending bosses disposed around the periphery of said extrusion head to form ice compressing passages between the adjacent bosses, said passages receiving the scraped slush ice from said auger and discharging the scraped slush ice therefrom after being compressed therein while passing therethrough, each of said bosses having means, including an extension of a predetermined axial length positioned below said lower end surface of said extrusion head and over a portion of said auger, for preventing the scraped slush ice from rotating together with said auger, the portion of said auger over which said extensions are positioned being sufficiently smaller in diameter than the other portions of said auger, so that interference by said extensions with said portion of said auger is avoided.

2. The icemaker set forth in claim 1, wherein said extensions have radially inner surfaces extending in parallel to the longitudinal axis of said auger.

3. The icemaker set forth in claim 2, wherein said smaller diameter is provided by removing a portion of said coiled scraper blade corresponding to the portion of said auger over which said extensions are located.

4. The icemaker set forth in claim 1, wherein a radially inner surface of each of said extensions extends downwardly while slanting radially outward toward the lowest end of each extension, and the portion of said coiled scraper blade over which said extensions are located has changing radial dimensions progressively decreasing approaching the lower end surface of said extrusion head.

* * * * *